United States Patent [19]

Granstrom et al.

[11] 4,315,124

[45] Feb. 9, 1982

[54] HEATING MODULES FOR BILLETS IN INDUCTIVE HEATING FURNACES

[75] Inventors: Staffan Granstrom; Gosta Karlsson, both of Vesteras, Sweden

[73] Assignee: ASEA Aktiebolag, Vesteras, Sweden

[21] Appl. No.: 959,215

[22] Filed: Nov. 9, 1978

[30] Foreign Application Priority Data

Nov. 16, 1977 [SE] Sweden ..... 7712917

[51] Int. Cl.[3] ..... H05B 6/22; H05B 6/44

[52] U.S. Cl. ..... 219/10.71; 219/10.75; 219/10.79

[58] Field of Search ..... 219/10.71, 10.69, 10.79, 219/10.75, 10.77, 10.61, 10.67

[56] References Cited

U.S. PATENT DOCUMENTS

| | | | |
|---|---|---|---|
| 1,809,468 | 6/1931 | Bornand et al. | 219/10.79 |
| 1,900,842 | 3/1933 | Northrup | 219/10.71 X |
| 2,430,640 | 11/1947 | Johnson | 219/10.79 |
| 2,448,009 | 8/1948 | Baker | 219/10.79 |
| 2,448,062 | 8/1948 | Stoltz | 219/10.71 |
| 2,647,982 | 8/1953 | Baker | 219/10.71 X |
| 2,669,647 | 2/1954 | Segsworth | 219/10.71 |
| 2,679,574 | 5/1954 | Wade | 219/10.61 |
| 2,722,589 | 11/1955 | Marquardt | 219/10.61 |
| 2,773,161 | 12/1956 | Baker | 219/10.77 |
| 3,182,169 | 5/1965 | Finzi | 219/10.71 |
| 3,471,673 | 10/1969 | Frostick | 219/10.71 |
| 4,158,758 | 6/1979 | Kunioka et al. | 219/10.71 X |

FOREIGN PATENT DOCUMENTS

| | | | |
|---|---|---|---|
| 7503828 | 5/1977 | Sweden | 219/10.71 |

*Primary Examiner*—Gene Z. Rubinson
*Assistant Examiner*—Philip H. Leung
*Attorney, Agent, or Firm*—Watson, Cole, Grindle & Watson

[57] ABSTRACT

An inductive billet heating apparatus in an inductive heating furnace for billets of rectangular section uses a plurality of paired heater modules having a flat shape. The billets are fed by a plurality of paired roller elements and each heater module in each pair of heater modules is suspended from respective ones of the paired roller elements on opposite sides of the billet such that a substantially constant distance from the opposite surfaces of the billets to the respective heater modules is independent of the thickness and/or straightness of the billets. At least some of the heater modules may be mounted to be rotatable in a plane parallel to the respective surfaces of the billets. The heater modules may be series-connected in pairs and the paired heater modules either series-connected or parallel-connected in groups.

10 Claims, 9 Drawing Figures

HEATING MODULES FOR BILLETS IN INDUCTIVE HEATING FURNACES

BACKGROUND

1. Field of the Invention

The present invention relates to an inductive heating furnace for billets having rectangular cross-section, so-called slabs, comprising roller pairs for feeding billets between several pairs of inductive heaters, and more particularly to modules for heating such billets.

2. Prior Art

A common drawback with heaters of the kind specified is that they require a mechanically complicated manipulating device for feeding billets in and out between the respective inductive heater coils. The capacitor bank for power factor correction is large and costly, partly because of the need for a high frequency, and partly because the induction coils have to be dimensioned for the largest billet, even if such sized billets do not constitute main production. Since a high frequency must be used to obtain a reasonable efficiency, the plant has required expensive static frequency convertors. One reason for using a high frequency has been the need to use a low penetration depth for the field generated by the heaters because of the location thereof and the shape of the billets.

SUMMARY OF THE INVENTION

The invention provides a solution to the above-mentioned problems and other problems associated therewith, and is characterized in that the heaters consist of modules of a flat shape arranged in pairs adjacent to the larger side surfaces of the billet and mechanically suspended from the billet guide rollers, whereby the heater modules move with the rollers, at least at one side of the billet. Thereby, the distance from the billet to the heater module is kept substantially constant independently of the thickness and/or non-straightness of the billet.

By positioning the heater modules in the manner stated above, they can be supplied with low-frequency current, for example power frequency current. If the currents in the coils included in the heater modules are in the same direction, a magnetic cross field is generated through the billet. The larger field penetration depth can then advantageously be accepted. The module-billet distance is automatically correct, and the need of capacitors per heating module is independent of the thickness of the billets. The number of heating modules can be adjusted to the length of the largest billet or to the conditions of production.

In a preferred embodiment, the billets are placed horizontally and the heater modules along respective upper and lower portions of the billet. The lower heater module is fixed to the underlay, and the upper rollers and heater modules are arranged to be able to be moved together relative to the billet, to accommodate different thickness and/or straightness of the billets. This provides for a simple and automatic adjustment of the billet module distance, and it will be possible to use a large field penetration depth, and therefore a low-frequency current supply.

The current supply is normally single-phase and the paired heater modules are series-connected. In other cases, however, multi-phase current supply may be used.

In another preferred embodiment, suitably used together with that mentioned above, the billet can be oscillated back and forth relative to the heater modules, the latter being suitably made in the form of so-called pancake coils. This provides compensation for an uneven power feed, for example when the plant is shorter than the billet. When the desired temperature of the billet has been reached, it can proceed directly to a subsequent rolling mill with a given production.

For different billet dimensions, production can be attained either by adjusting the power or voltage to the heater modules, or by adjusting the rate of feeding or oscillation of the billets through the furnace (in case of constant voltage). A combinatiion of these methods of adjusting may, of course, be used as well.

In another practical embodiment, the heater modules can be made rotatable or displaceable in accordance with the dimensions of the billets used, and the width of the induction field can be adjusted to the width of the billet.

BRIEF DESCRIPTION OF THE DRAWINGS

The invention is exemplified in detail in the accompanying drawings wherein.

DETAILED DESCRIPTION

Figure 1:
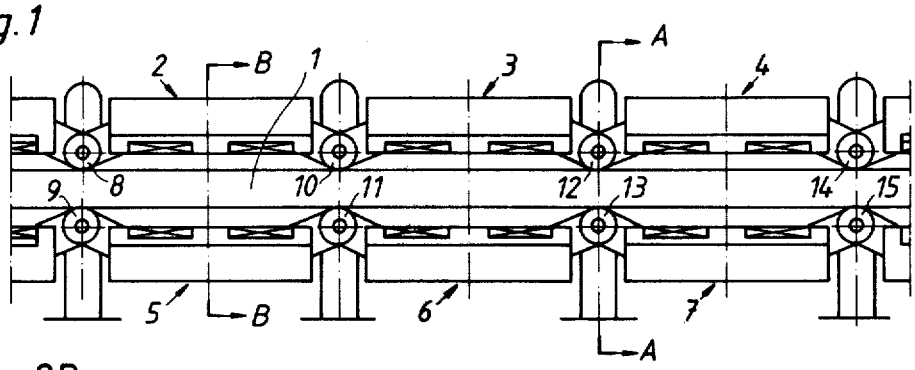
FIG. 1 is a side view of a heating device and FIGS. 2A and 2B represent sections taken respectively through A—A and B—B of FIG. 1.
Figure 2B:
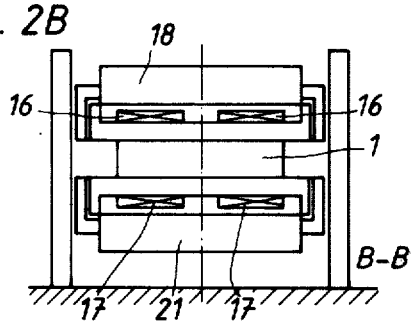
Figure 2A:
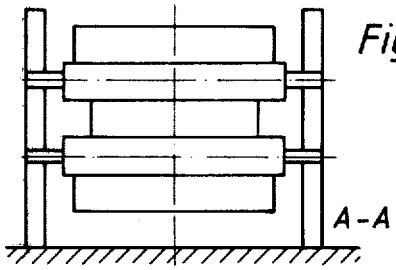

FIG. 1 shows a plant according to the invention, which is arranged around a horizontally extending track for a billet 1 having rectangular section as shown in FIGS. 2A, 2B. The plant comprises heater modules 2–7 with pancake coils which can be made with square, rectangular, oval or circular extension (see FIG. 3).

Billet 1 is arranged to be fed by means of a drive mechanism (not shown) which accelerates the billet at a suitable location along its path and is controlled through the plant by means of guide rollers 8–15 arranged pairwise. Guide rollers 8–15 are non-driven, or possibly completely or partly driven. Lower guide rollers 9, 11, 13, 15 are mounted on a suitable base and mechanically connected with lower heater modules 5–7. While upper rollers 8, 10, 12, 14 are also mechanically connected to heater modules 2–4, they are mounted to be movable with respect to the upper surface of billet 1 together with the heater modules. Thus, for different billet dimensions and different degrees of straightness, a substantially constant distance from the heater modules to the upper surface of the billet is always ensured, and the distance from the billet to lower modules 5–7 is of course also constant. This overcomes one problem in connection with so-called slab heating, namely the insufficient straightness of the billet.

FIGS, 2A, 2B respectively show a section through modules 2–5 (section B—B), and through guide rollers 12–13 (section A—A). Coil 16 in module 2 is shown with an iron core 18 (yoke) and coil 17 with an iron core 21.

Figure 3:
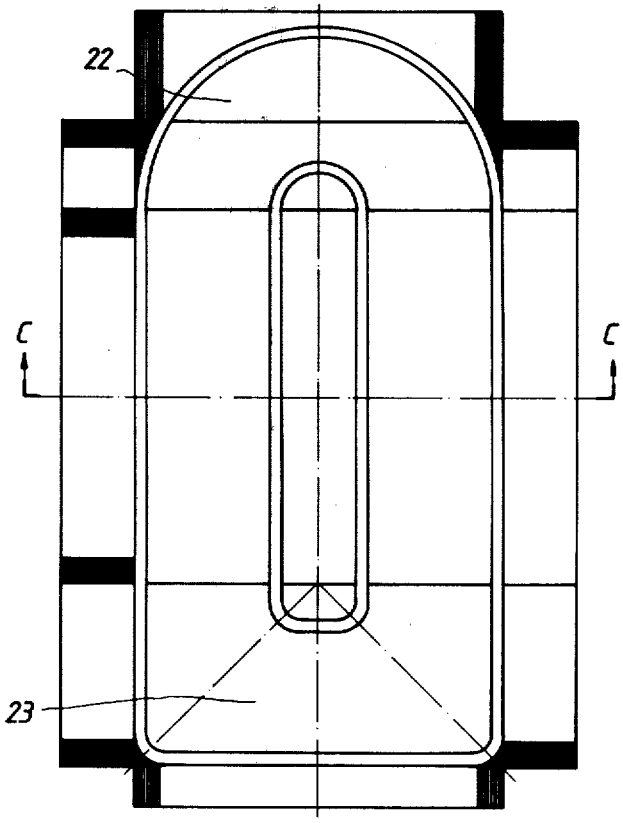
FIG. 3 shows different shapes of the pancake coils of the heater modules.

The coil shape may, according to the invention, be square, rectangular, circular or oval, and FIG. 3 shows an oval coil 22 at the top and a rectangular coil 23 (with rounded corners) at the bottom.

Figure 4:
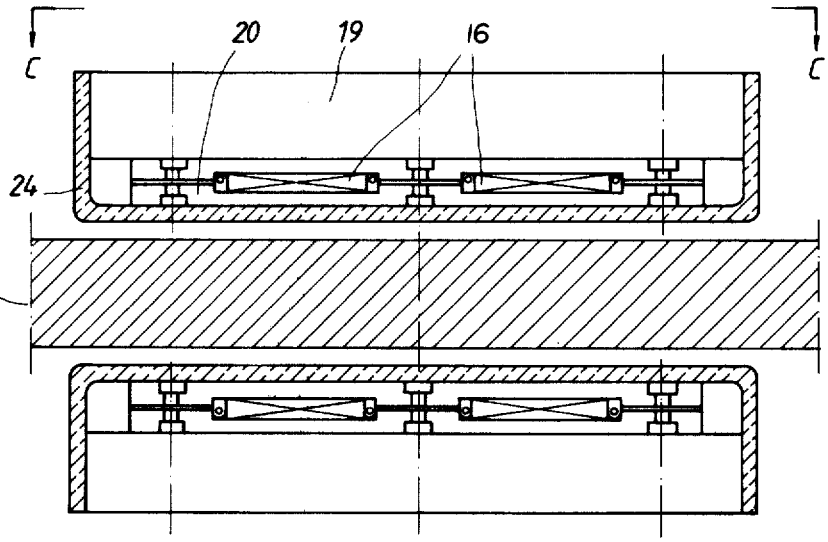
FIG. 4 is a section along line C—C in FIG. 3.

FIG. 4 shows a section C—C through the coil of FIG. 3. The coils are shown at 16 and the iron core at 19. Numeral 20 designates an asbestos wood supporting plate, and 24 is heat insulation. FIG. 4 illustrates the short and constant distance from the heater module/coil to billet 1, both at the upper and at the lower larger side surface of the billet.

Figure 5:
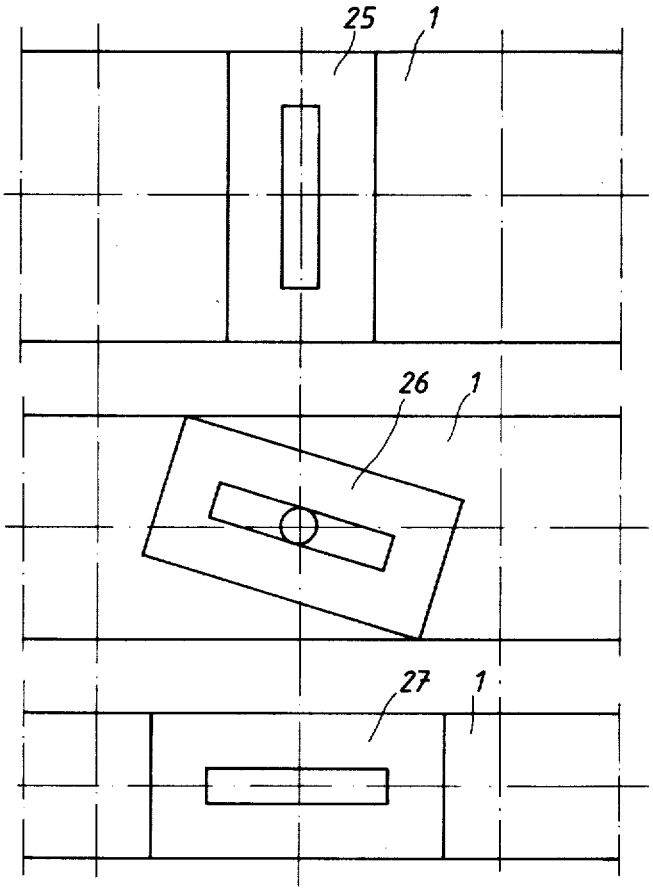
FIG. 5 shows rotatable heater modules.

The different heater modules can suitably be made rotatable or displaceable for adjustment to different billet widths for the non-circular cases (see FIG. 5). Heater module 25, which is rectangular, is positioned at the top of FIG. 5 with its longer side across billet 1, which is thus completely covered by the heater module and is thus heated substantially uniformly across its width.

In the middle of FIG. 5, heater module 26 has been rotated at a certain angle, so that the width of the billet is covered by the heater module. In this case the billet has a different width than the billet shown above, but in spite of this it is well covered by the heater module.

At the bottom of FIG. 5, the shorter side of heater module 27 is placed across an even thinner billet 1. Thus, by rotating or displacing the heater modules, a good covering of different billet dimensions may be obtained.

The number of heater modules is often chosen according to the total length of the billet. However, if, for example, the length of a billet should not correspond to the total length of the heater module, the billet can be oscillated back and forth in the plant until the necessary billet temperature has been achieved, for example for immediate transfer to a hot rolling mill. The rate of billet feed can also be made adjustable to obtain the necessary billet temperature.

In the arrangement according to FIGS. 1–5 the advantage is gained that there is no additional need of voltage and capacitor power control for the different widths of the billet which can be covered by induction heater coils. The different heater modules in each pair of heater modules 2–5, 3–6, 4–7 are mutually series-connected and fed with single-phase, power frequency current (50 Hz).

Figure 7:
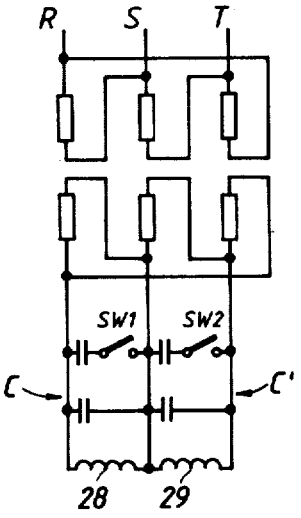
FIGS. 7 and 8 show a V-connection and a delta connection, respectively, heating module groups.
Figure 8:
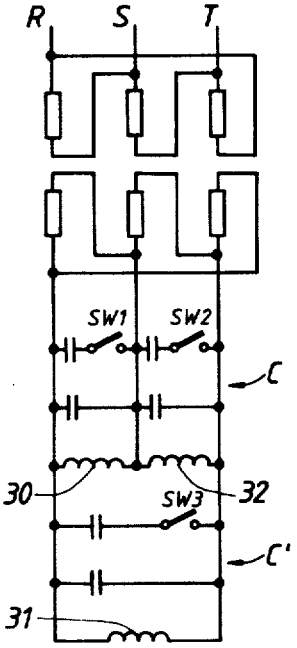

A number of series-connected heater modules may either be V-connected (FIG. 7), or be three-phase connected between the three phases RS, ST and TR (FIG. 8). FIG. 7 shows one group of series-connected heater module coils at 28 and one group at 29. Corresponding heater module coils 30–32 are shown in FIG. 8. The V-connection (FIG. 7) is carried out in such a way that heater module coils 28 and 29, respectively, comprising mutually series-connected heater modules, are connected between phases RS and TS, respectively, and the symmetrization of the load is performed by angularly adjusting the capacitor banks C, C' between the phases without having to increase the total capacitor requirement. Such load symmetrization is carried out by opening or closing switches SW1–SW2 (FIG. 7) or SW1–SW3 (FIG. 8) in a manner known to those skilled in the art.

In case of a three-phase connection (FIG. 8), a completely symmetrical load is obtained, and therefore no additional symmetrization devices are needed other than those provided by the capacitor banks C, C'.

Since the voltage requirement per heating module is small, partly because of the low frequency, partly because of the relatively high power factor, and the compact design of the heater modules, a number of heater modules should be series-connected to obtain an optimum voltage for the capacitor banks.

The heat-retaining plant and the capacitor banks (for symmetrization) are connected to the power supply network through a three-phase transformer with an adjustable or fixed ratio, depending on whether capacity control or speed control is used, to provide the same heating time independent of the dimension of the billet.

Figure 6:
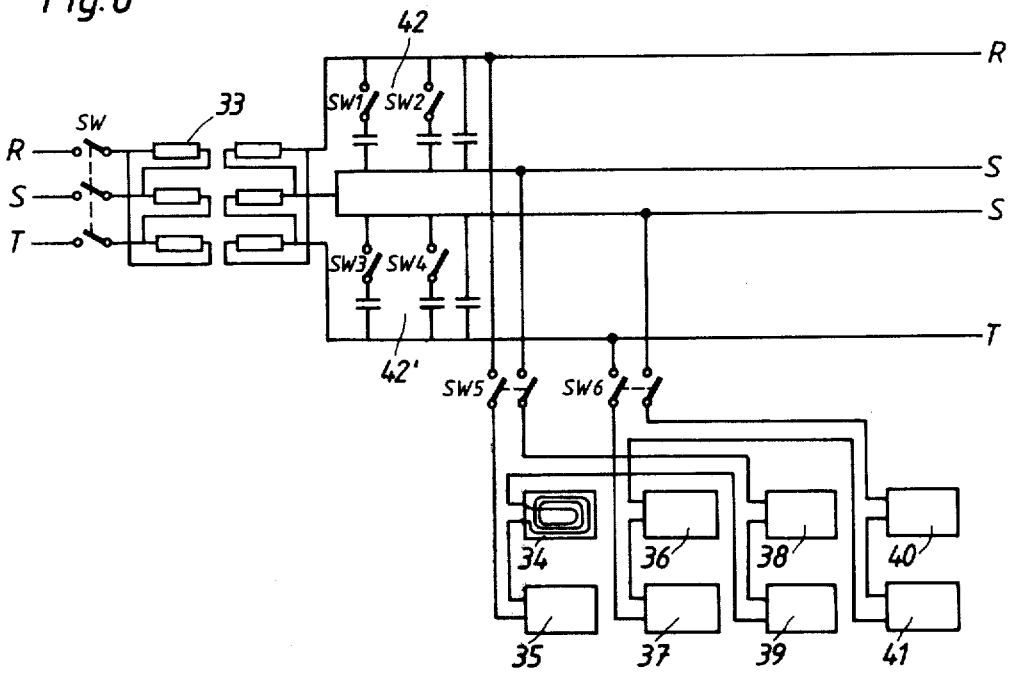
FIG. 6 shows a circuit diagram of an electrical connection for the heater modules.

A principal diagram for the electrical connection of the heater modules is shown in FIG. 6. Transformer 33 is connected to the three-phase network RST by interlocked switch SW. The heating plant with the series-connected module pairs 34–35, 38–39 and 36–37, 40–41, respectively, is V-connected to the network through ganged switches SW5, SW6, and symmetrization is made possible by capacitor banks 42, 42'. No special symmetrization equipment is needed.

By series-connecting a number of heating modules, an optimum voltage for the capacitor banks can be selected (the smallest posible cost in SwKr pr kVAr). One capacitor for each heater module is too expensive, and in accordance with the invention, one capacitor for several heater modules in series can be utilized.

The handling of the billets is facilitated by the use of a plant according to the invention. The heating furnace can be placed in the billet transport paths which normally feed the billets to the rolling mill. No extra lifting operations or transporting of the billets between different heating sections is required.

Any uneven power feed into the billets because of the magnetic cross field, which results from an uneven temperature rise in the billet if the billet is stationary in the furnace, can be compensated by feeding or oscillating the billet back and forth in the furnace along the length of one or more heater modules. This oscillating of the billet requires DC operation of the drive motors if the temperature increase is adjusted with the billet drive speed.

Because the billet width dimensions the size of the coils, the power and the production for each heater module are limited. The physical limitation of the extension of the current range sets a limit to the field strength in the coil. This limitation is compensated by series-connecting a number of heater modules to achieve a desired production. It is also possible to connect several heating furnaces in parallel.

What is claimed is:

1. Inductive billet heating apparatus in an inductive heating furnace for billets having a rectangular section, comprising:

a plurality of paired heater modules having a flat shape;

a plurality of paired roller elements for feeding the billets between said plurality of heater modules;

each heater module in each pair of said heater modules being directly suspended from respective ones of said paired roller elements on opposite sides of a billet such that a substantially constant distance from the opposite surfaces of the billets to the respective heater modules in each pair of heater modules is maintained by movement of said paired roller elements on the respective opposite surfaces of the billet independently of the thickness and/or variations in thickness of the billet; and each said pair of heater modules being independently rotatable in a plane substantially parallel to the confronting surfaces of the billets.

2. Inductive billet heating apparatus according to claim 1, wherein the billets are transported on a horizontally extending track and the roller elements of each said pair of roller elements respectively engage opposite upper and lower surfaces of the billets and the lower roller elements of each said pair of roller elements being fixed to the underlay and the upper roller elements of each said pair of roller elements and the heater modules associated therewith being movable together relative to the billet in accordance with different thicknesses and/or variations in thickness of the billets.

3. Inductive billet heating apparatus according to claim 1, wherein each heater module comprises non-circular pancake coils arranged with their planes parallel to the plane of the billets.

4. Inductive billet heating apparatus according to claim 1, wherein each heater module comprises circular pancake coils, arranged with their planes parallel to the plane of the billets.

5. Inductive billet heating apparatus according to claim 1, wherein the paired roller elements are adapted to oscillate the billets with respect to the heater modules.

6. Inductive billet heating apparatus according to claim 1, wherein the heater modules are series-connected in pairs, and the paired heater modules are series-connected in groups.

7. Inductive billet heating apparatus according to claim 6, wherein a number of said series-connected modules are V-connected between three phases of an excitation power source.

8. Inductive billet heating apparatus according to claim 1, wherein the heater modules are series-connected in pairs, and the paired heater modules are parallel-connected in groups.

9. Inductive billet heating apparatus according to claim 8, wherein a number of series-connected modules are three-phase connected between three phases of an excitation power source.

10. Inductive billet heating apparatus according to claim 1, wherein the heater modules are fed with single-phase power frequency current.

* * * * *